US008771439B2

(12) United States Patent
Qu et al.

(10) Patent No.: US 8,771,439 B2
(45) Date of Patent: Jul. 8, 2014

(54) TITANIUM ALUMINIDE INTERMETALLIC ALLOYS WITH IMPROVED WEAR RESISTANCE

(75) Inventors: Jun Qu, Knoxville, TN (US); Hua-Tay Lin, Oak Ridge, TN (US); Peter J. Blau, Knoxville, TN (US); Vinod K. Sikka, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 667 days.

(21) Appl. No.: 12/416,323

(22) Filed: Apr. 1, 2009

(65) Prior Publication Data

US 2010/0252146 A1 Oct. 7, 2010

(51) Int. Cl.
*C23C 8/10* (2006.01)
*C23C 8/06* (2006.01)

(52) U.S. Cl.
USPC ..... 148/284; 148/276; 148/277; 148/281; 148/668; 148/669; 148/670; 148/671; 420/417; 420/418

(58) Field of Classification Search
USPC ..... 148/281, 276–277, 284, 668–671; 420/417, 418
See application file for complete search history.

(56) References Cited

U.S. PATENT DOCUMENTS

| | | | | |
|---|---|---|---|---|
| 5,049,418 | A | 9/1991 | Tobin | |
| 5,518,820 | A * | 5/1996 | Averbach et al. | 428/469 |
| 5,672,436 | A | 9/1997 | Tobin | |
| 5,776,266 | A | 7/1998 | Tobin | |
| 6,270,914 | B1 | 8/2001 | Ogasawara et al. | |
| 6,599,636 | B1 | 7/2003 | Alger | |
| 6,933,053 | B2 * | 8/2005 | Alger | 428/472 |
| 2008/0000558 | A1 | 1/2008 | Yang et al. | |

FOREIGN PATENT DOCUMENTS

| | | | | |
|---|---|---|---|---|
| CN | 1490429 | * | 4/2004 | C23C 8/10 |
| JP | 03-177557 | * | 8/1991 | C23C 8/02 |
| JP | 06-081847 | * | 3/1994 | F16C 33/62 |

OTHER PUBLICATIONS

Qu J. et al., "Oxygen Diffusion Enables Anti-Wear Boundary Film Formation on Titanium Surfaces in Zinc-Dialkyl-Dithiophosphate (ZDDP)-Containing Lubricants", *Scripta Materialia* 60:886-889 (2009).

Clemens H. et al., "Processing and Applications of Intermetallic γ-TiAl-Based Alloys", *Advanced Engieering Materials* 2(9):551-570 (2000).

Kekare S.A. et al., "Oxidation of TiAl Based Intermetallics", *Journal of Materials Science* 32:2485-2499 (1997).

"Dramatic Friction and Wear Reductions for Titanium Alloys Using Oxygen Diffusion-Reducing Friction by Up to 70% and Wear by Up to One-Million Times", Oak Ridge National Laboratory Fact Sheet, presented to Eaton Corporation on Sep. 19, 2007.

Qu J. et al., "Oxygen-Diffused Titanium as a Candidate Brake Rotor Material", *Wear* 267:818-822 (2009).

* cited by examiner

*Primary Examiner* — Lois Zheng
(74) *Attorney, Agent, or Firm* — Scully, Scott, Murphy & Presser, P.C.

(57) ABSTRACT

The invention is directed to a method for producing a titanium aluminide intermetallic alloy composition having an improved wear resistance, the method comprising heating a titanium aluminide intermetallic alloy material in an oxygen-containing environment at a temperature and for a time sufficient to produce a top oxide layer and underlying oxygen-diffused layer, followed by removal of the top oxide layer such that the oxygen-diffused layer is exposed. The invention is also directed to the resulting oxygen-diffused titanium aluminide intermetallic alloy, as well as mechanical components or devices containing the improved alloy composition.

20 Claims, 3 Drawing Sheets

TITANIUM ALUMINIDE INTERMETALLIC ALLOYS WITH IMPROVED WEAR RESISTANCE

This invention was made with government support under Contract Number DE-AC05-00OR22725 between the United States Department of Energy and UT-Battelle, LLC. The U.S. government has certain rights in this invention.

FIELD OF THE INVENTION

The present invention relates generally to the field of wear-resistant alloys, and more particularly, to titanium aluminide intermetallic alloys.

BACKGROUND OF THE INVENTION

Titanium aluminide intermetallic alloy materials (i.e., typically TiAl, $TiAl_3$, or $Ti_3Al$) are generally known for their superior mechanical resilience at elevated temperatures. In particular, the titanium aluminide intermetallic alloys (i.e., Ti—Al intermetallic alloys) are generally more attractive for extreme temperature applications (e.g., hypersonic aircraft, gas turbines, and the like) than the non-intermetallic titanium aluminum alloys, hereinafter referred to as "titanium-aluminum alloys" or "titanium alloys". The reason for this is based primarily on the distinct compositional and microstructural characteristics of the Ti—Al intermetallic alloys as compared to the titanium alloys.

However, though the Ti—Al intermetallic alloys are superior in mechanical resilience, their poor wear-resistance has drastically limited their use to non-wear or low-wear conditions. For this reason, Ti—Al intermetallic alloys have not generally been applied to critical high-wear situations which would otherwise benefit from the superior mechanical resilience of these alloys. Therefore, there is an ongoing effort to produce Ti—Al intermetallic alloys having an improved wear resistance.

It is generally known to produce a non-intermetallic titanium alloy (e.g., Ti-6Al-4V) with improved wear resistance by treating the titanium alloy by a heating process in the presence of air in order to incorporate an oxygen-diffused (OD) layer thereon. However, the process used for the titanium alloys has thus far not been successful for the Ti—Al intermetallic alloys since the conditions generally employed for producing an OD layer on the titanium alloys are incapable of producing an OD layer on the Ti—Al intermetallic alloys.

Accordingly, there is a need in the art for a method capable of producing Ti—Al intermetallic alloys with an improved wear resistance. The resulting wear-resistant Ti—Al intermetallic alloys would advantageously no longer be limited to low-wear or no-wear applications, but rather, completely applicable to high-temperature and high-wear applications, where they are particularly needed.

SUMMARY OF THE INVENTION

In one aspect, the invention is directed to a method for producing a Ti—Al intermetallic alloy having an improved hardness and wear resistance. The method generally involves incorporating an oxygen-diffused layer (which functions as the wear-resistant working surface) on the surface of the Ti—Al intermetallic alloy, wherein the oxygen-diffused layer has the effect of increasing the surface hardness, reducing the friction coefficient (i.e., coefficient of friction), and decreasing the wear rate (hence, increasing the wear resistance) of the intermetallic alloy as compared to the intermetallic alloy without an oxygen-diffused layer.

According to a preferred embodiment of the invention, the method preferably involves heating a Ti—Al intermetallic alloy material in an oxygen-containing environment at a temperature and for a time sufficient to produce a top oxide layer and underlying oxygen-diffused layer, followed by removal of the top oxide layer such that the oxygen-diffused layer is exposed.

In another aspect, the invention is directed to the Ti—Al intermetallic alloy material, produced as above, having an improved wear resistance, wherein the intermetallic alloy contains on its surface an exposed oxygen-diffused layer, i.e., in the absence of an oxide layer.

In yet another aspect, the invention is directed to a mechanical component or device containing the improved Ti—Al intermetallic alloy described above. The mechanical component or device is typically directed to an application in which mechanical resilience and high wear-resistance are both required. The mechanical component can also be utilized in an application in which a significant degree of thermal resistance is required.

Thus, the present invention provides a method for producing Ti—Al intermetallic alloys with an improved wear resistance. The method and resulting wear-resistant Ti—Al intermetallic alloys advantageously expand the utility of these intermetallic alloys to high-wear applications. Numerous benefits will result by this invention, most notably the increased mechanical integrity of critical components subjected to extreme wear conditions, temperatures, and mechanical stresses.

DETAILED DESCRIPTION OF THE INVENTION

Figure 1:
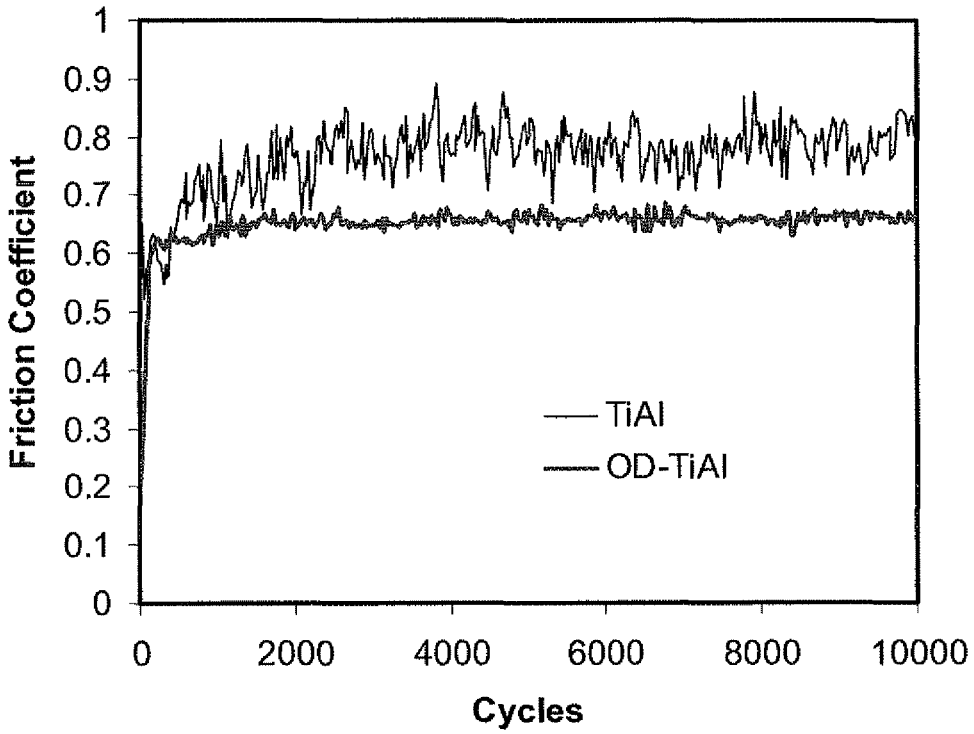
FIG. 1. Graph showing friction coefficient of an oxygen-diffused Ti—Al intermetallic alloy of the invention (i.e., "OD-TiAl") as a function of the number of dry sliding wear cycles against AISI 52100 bearing steel.
Figure 2:
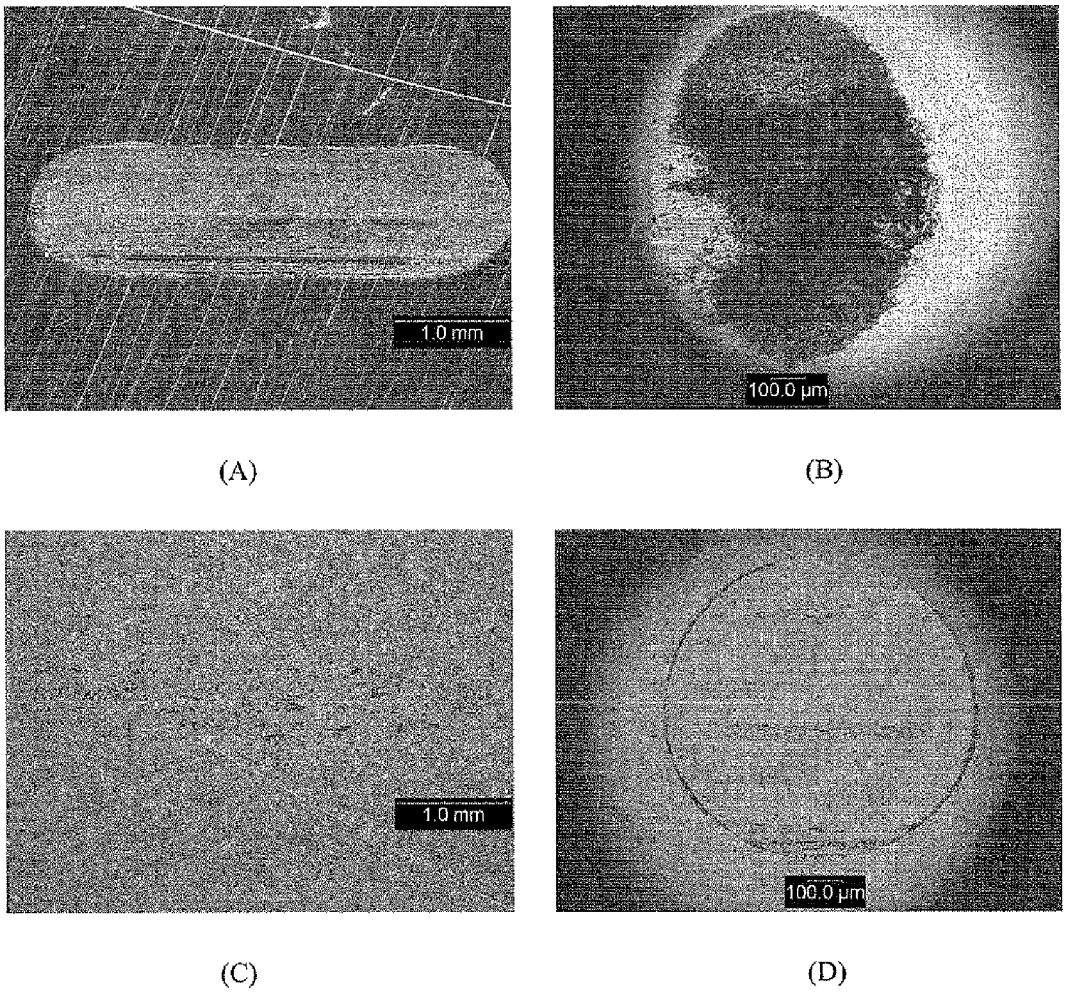
FIGS. 2A-2D. Surface images for untreated TiAl (FIG. 2A) and the steel counterface (FIG. 2B), and surface images for OD-TiAl (FIG. 2C) and the steel counterface (FIG. 2D), after 10,000 cycles of dry sliding against the steel counterface (a AISI 52100 bearing steel ball).

In one aspect, the invention is directed to a method for producing a Ti—Al intermetallic alloy having an improved wear resistance. The Ti—Al intermetallic alloy compositions considered herein typically belong to a composition governed by one of the general formulas TiAl (e.g., γ-TiAl), $TiAl_3$, or $Ti_3Al$ (e.g., α3-$Ti_3Al$). Of these, the TiAl-based alloys (e.g., conventional engineering γ-TiAl-based alloys) are the most common. A significant portion of the TiAl-based alloys can be conveniently summarized by the formula:

$$Ti_{45\text{-}52}—Al_{45\text{-}48}—X_{1\text{-}3}—Y_{2\text{-}5}—Z_{<1} \quad (1)$$

wherein X is any suitable metal (typically, Cr, Mn, or V), Y is any suitable metal (typically, Nb, Ta, W, or Mo), and Z is any suitable main group element (e.g., Si, B, or C), wherein the numerical subscripts are atomic percentages (at %). Some exemplary classes of TiAl-based alloys considered herein include the Ti-48Al alloys, Ti-47Al alloys, Ti-46Al alloys, Ti-45Al alloys, Ti-44Al alloys, Ti-43Al alloys, and Ti-42Al alloys.

Some specific examples of Ti-48Al alloys include Ti-48Al-2Nb-0.7Cr-0.3Si, Ti-48Al-2Nb-2Cr, Ti-48Al-1.4Mn, Ti-48Al-0.2W, Ti-48Al-2Cr, Ti-48Al-2W, Ti-48Al-1.5Cr, Ti-48Al-10Nb, Ti-48Al-5Nb, Ti-48Al-2Mn-2Nb, and Ti-48Al. Some specific examples of Ti-47Al alloys include Ti-47Al-2Ce-0.2Si, Ti-47Al-2Nb-2Cr, Ti-47.5Al-2.5V, Ti-47Al-0.5W, Ti-47Al-2Cr-1Nb-1Ta, Ti-47Al-2Nb-1Mn-0.5W-0.5Mo-0.2Si, Ti-46.5Al-2Cr-2Nb-0.8Mo-0.2W-0.2Si, Ti-47Al-2Nb-1Mn, Ti-47Al-0.5W, Ti-47Al-1 Cr, Ti-47Al-2Cr-4Nb, Ti-47Al-2Mn-2Nb, Ti-47Al-2Cr-2Nb-0.2B, Ti-47Al-2Cr-0.2Si, and Ti-47Al. Some specific examples of Ti-46Al alloys include Ti-46Al-5Nb-1W, Ti-46Al-2W-0.5Si, Ti-46Al-1.5Mo-1Si, Ti-46Al-1.5Mo-0.2C, Ti-46Al-3Nb-1W-0.1B, Ti-46Al-3Nb-2W-0.1B, Ti-46Al-2W, Ti-46Al-7Nb-1.5Cr, Ti-46Al-9Nb, Ti-46Al-2Nb-2Mn, Ti-46Al-2Mn-2b-0.2B, Ti-46Al-2Cr-2Nb-0.9Mo, and Ti-46Al. Some specific examples of Ti-45Al alloys include Ti-45Al-2Nb-2Cr, Ti-45Al-10Nb, Ti-45Al-8Nb, Ti-45Al-5Nb, Ti-45Al-2Mn-2Nb, Ti-45Al-2Mn-2Nb-1B, Ti-45Al-7Nb-0.15B-0.4W, Ti-45Al-2Mn-2Nb, Ti-45Al-5Nb-0.5C, Ti-45Al-2Cr-4Nb-10.5Mn, Ti-45Al-5Nb-0.2B-0.2C, and Ti-45Al. Some specific examples of Ti-44Al alloys include Ti-44Al-11Nb, Ti-44Al-4Nb, Ti-44Al-4Nb-4Zr, Ti-44Al-7Nb, Ti-44Al-8Nb, Ti-44Al-5Nb-0.2B, Ti -44Al-0.5Cr, Ti-44Al-2Mo, Ti-44Al-5V-1Cr, and Ti-44Al. Some specific examples of Ti-43Al alloys include Ti-43Al -4Nb-1Mo-0.1B, Ti-43Al-3Si, Ti-43Al-1Cr-1.7Nb, Ti-43Al-5Mn, and Ti-43Al-5Cr. Some other examples of TiAl-based alloys include Ti-55Al-25Ta, Ti-53Al-15Cr, Ti-50Al-2Mn-1Nb, Ti-50Al-10Cr, Ti-49Al, Ti-49Al-49Cr-2, Ti-49Al-0.1 Mn, Ti-49Al-1V, Ti-49Al-2Cr-3Ta, Ti-42Al-6Mo, Ti-42Al-5Mn, Ti-42Al-10 Mn, and Ti-33.5Al-1Nb-0.5 Si-0.5Cr.

In the method of the invention, a Ti—Al intermetallic alloy is first subjected to a heat treatment step in an oxygen-containing environment such that a top oxide layer and an underlying oxygen-diffused layer is produced on the surface of the Ti—Al intermetallic alloy. The produced oxide layer is characterized by the presence of a titanium and/or aluminum oxide composition (e.g., $TiO_2$, $Ti_2O_3$, and/or $Al_2O_3$), wherein the precise composition is dependent on several variables during the heating process, such as temperature, partial pressure of oxygen, and humidity (i.e., percent water vapor). The oxide layer, which can typically be from a fraction to several hundreds of microns in thickness, is often composed of layers of distinct oxide compositions or phases (e.g., an $\alpha$-$Al_2O_3$ layer underlying a $Ti_2O_3$ or $TiO_2$ layer). Typically, the oxide layer is readily identifiable as having a greenish hue and a brittle (i.e., highly frangible) characteristic. In contrast to the oxide layer, the underlying oxygen-diffused layer is characterized not by the presence of oxide atoms, but by the presence of oxygen atoms that have diffused below the oxide layer to form a metal-oxygen solid solution. In further contrast to the oxide layer, the oxygen-diffused layer is metallic in appearance and highly robust (e.g., non-brittle). A comprehensive reference which further elaborates on the various properties of, and distinctions between, oxide and oxygen-diffused layers in Ti—Al compositions is found in S. A. Kekare, et al., "Oxidation of TiAl Based Intermetallics", *Journal of Materials Science,* 32, pp. 2485-2499 (1997), the entire disclosure of which is herein incorporated by reference.

The oxygen-diffused layer can have any suitable thickness, e.g., typically, at least micron (1 μm) and up to several hundreds of microns. For example, in different embodiments, the oxygen-diffused layer has a thickness of at least 1, 2, 3, 4, 5, or 10 microns and up to 20, 30, 40, 50, 60, 70, 80, 90, 100, 150, 200, 250, 300, 350, 400, 450, 500, 600, or 700 microns, or any particular range established by these minimum and maximum values. More typically, the oxygen-diffused layer has a thickness in the range of 1-50 microns (e.g., 10, 15, 20, 25, 30, 35, 40, 45, or 50 microns, or any range between any of these values). Several processing variables, such as temperature, processing time, partial pressure of oxygen, and humidity, have an affect on the thickness and other physical characteristics of the oxygen-diffused layer.

The heat treatment step entails heating the Ti—Al intermetallic at a suitable temperature for sufficient time in an oxygen-containing environment such that a top oxide layer and an underlying oxygen-diffused layer is produced on the surface of the Ti—Al intermetallic alloy. Typically, the heating temperature is at least about 800° C. and up to about 1100° C. For example, in different embodiments, the heating temperature can be 800° C., 850° C., 900° C., 950° C., 1000° C., 1050° C., or 1100° C., or any particular range established by any two of these values. Preferably, the heating temperature is at least 950° C., 1000° C., or 1050° C. and up to about 1100° C.

Typically, a sufficiently developed oxide and oxygen-diffused layer is produced by heating the TiAl intermetallic alloy at a temperature of about 950° C. for a minimum processing time of, for example, at least about 10 hours, and a maximum processing time up to, for example, 20, 30, 40, 50, 60, 70, 80, 90, 100, 120, 150, or 200 hours. Since higher temperatures accelerate formation of oxide and oxygen-diffused layers, use of a temperature above 950° C. will require less processing time to achieve oxide and oxygen-diffused layers of equivalent thickness to those produced at 950° C. For example, at a temperature of 1000° C., a preferred minimum processing time can be, for example, about 2, 3, or 4 hours, while at a temperature of 1050° C. a preferred minimum processing time can be, for example, about 1-2 hours, while at a temperature of 1100° C. a preferred minimum processing time can be less than 1 hour, for example, about 0.5 hours or less.

The oxygen-containing environment can be any such gas or gas mixture known in the art containing oxygen. Typically, the oxygen-containing environment is either air (i.e., unmodified or modified) or an oxygen-inert gas mixture. A modified air environment can be, for example, oxygen-enriched or oxygen-depleted air. Some examples of oxygen-inert gas mixtures include oxygen-nitrogen, oxygen-helium, and oxygen-argon mixtures. The concentration of oxygen is typically at least about 1 vol %. In different embodiments, the oxygen concentration may preferably be, for example, 1, 2, 5, 10, 15, 20, 25, 30, 35, 40, 45, 50, 55, 60, 65, 70, 75, 80, 85, 90, or 95 vol %, or within a range established by any two of these values. An oxygen concentration less than 1 vol % can also be used (e.g., at least 1, 5, 10, or 50 ppm, and up to 100, 500, 1,000, or 5,000 ppm). However, such lower oxygen concentrations will generally require significantly longer heat processing times.

The oxygen-containing gas or gas mixture can also contain any suitable level of water vapor (i.e., humidity level). In one embodiment, there is a substantial absence of water vapor such that the humidity of the gas or gas mixture is negligible (e.g., less than 10 ppm) or essentially zero (e.g., at or less than 1 ppm). In another embodiment, a non-negligible humidity level is employed in the oxygen-containing gas. In different embodiments, the humidity level of the gas or gas mixture may be, for example, at least 10, 20, 30, 40, 50, or 100 ppm, and up to 150, 200, 250, 300, 400, 500, 600, 700, or 800 ppm, or any particular range established by any of these minimum and maximum values.

After an oxide layer and underlying oxygen-diffused layer is produced, the oxide layer is removed such that the oxygen-diffused layer is exposed. Due to the brittleness of the oxide layer, the oxide layer can generally be easily removed by mechanical abrasion, e.g., by rubbing and/or polishing with an abrasive material, such as silicon carbide or aluminum oxide grit paper. By virtue of the difference in appearance and physical properties of the oxide layer and underlying oxygen-diffused layer, the polishing step can be conducted such that substantially complete removal of the oxide layer is achieved while leaving the underlying oxygen-diffused layer intact.

In another aspect, the invention is directed to the produced Ti—Al intermetallic alloy having on its surface an exposed oxygen-diffused layer (OD) in the substantial absence of an oxide layer (i.e., the produced OD-TiAl material). The resulting OD-TiAl material has an improved wear resistance. The improved wear resistance is evident in an improved wear rate (e.g., in units of $mm^3$/N-m or other convenient units). Preferably, the wear rate of the OD-TiAl material is at least 10 times less than the wear rate of untreated TiAl material under substantially identical testing conditions. In particular embodiments, the wear rate of the OD-TiAl material is at least 10, 100, 1000, or 10,000 times less than the wear rate of the untreated TiAl material under substantially identical testing conditions. It is understood that there is no absolute or standard scale by which wear rate is measured and that wear rate values are highly dependent on the particular testing conditions. Accordingly, wear rate values are truly comparative only when the values have been obtained under substantially identical testing conditions.

The OD-TiAl material possesses one or more improved physical properties which impart the improved wear rate and other improved properties (e.g., improved fracture toughness and heat resistance). In one embodiment, the OD-TiAl material possesses an improved friction coefficient (e.g., a steady-state friction coefficient) as compared to the friction coefficient of untreated TiAl material. In particular embodiments, the OD-TiAl material possesses a friction coefficient that is at least 10%, 15%, 20%, 25%, 30%, 40%, or 50% reduced over the friction coefficient of untreated TiAl material. In another embodiment, the OD-TiAl material possesses an improved hardness (e.g., Knoop's hardness) as compared to the hardness of untreated TiAl material. In particular embodiments, the OD-TiAl material possesses a microindentation Knoop's hardness of at least 6.0, 7.0, 8.0, or 9.0 GPa.

In yet another aspect, the invention is directed to a mechanical component or device (and more generally, an object) containing the OD-TiAl material described above. By "containing" the OD-TiAl is meant that the OD-TiAl material is found in at least the surface of the component or device, e.g., either by functioning as a layer on a substrate material or by functioning as the sole material of the component (i.e., surface and bulk portions). The mechanical component primarily considered herein is one which is intended to be used in operations that subject the component or device to significant tribological stress. A primary example of such a mechanical component is a bearing, and particularly a slide bearing. Other types of bearings that can benefit by the invention include, for example, plain bearings, rolling element bearings, and jewel bearings. The mechanical component considered herein can also be one which is intended to be used in high temperature operations by virtue of the increased heat resistance of the OD-TiAl material. Some examples of heat-resistant mechanical components include turbine fans, compressor blades, pistons, elements of a thermal protection system, an exhaust engine valve, and a turbocharger.

The mechanical component or device can also have any suitable shape or form, either in bulk form or as a coating on a substrate. For example, in different embodiments, the OD-TiAl material may have a generally cylindrical, tubular, ring, spherical, ingot, disk (e.g., circular blade or saw), sheet, wire, mesh, grooved, particulate, or jagged type of shape, depending on the particular application. When the OD-TiAl material is used as a coating, or as a sheet or film, the OD-TiAl coating, sheet, or film can have any suitable thickness or diameter, e.g., in different embodiments, at least (or alternatively, no more than) 10 μm, 20 μm, 50 μm, 100 μm, 200 μm, 500 μm, 1 mm, 2 mm, 5 mm, 10 mm, 20 mm, or a range between any two of these values.

Examples have been set forth below for the purpose of illustration and to describe certain specific embodiments of the invention. However, the scope of this invention is not to be in any way limited by the examples set forth herein.

EXAMPLE 1

Preparation of an OD-TiAl Material

A titanium aluminide intermetallic alloy (TiAl) of composition Ti-48Al-2Nb-0.7Cr-0.3Si (i.e., TiAl RNT650) was used for demonstration. TiAl specimens were furnace-treated in air at 950° C. for 40 hours and then air-cooled. Silicon carbide abrasive papers were used to remove the oxide scales to expose the underneath oxygen-diffused layer.

EXAMPLE 2

Testing and Evaluation of the OD-TiAl Material

Tribological wear testing of OD-TiAl (as prepared above) and untreated TiAl was conducted by dry sliding the alloys against an AISI 52100 bearing steel counterface using a ball-on-flat reciprocating sliding configuration under 5 N load and 4 mm oscillation stroke at 5 Hz frequency for 10,000 cycles. A side-by-side comparison of hardness, friction, and wear are summarized in Table 1 below.

TABLE 1

Friction and wear results in dry sliding against 52100 bearing steel

| Property | TiAl | OD-TiAl | Improvement by oxygen diffusion |
|---|---|---|---|
| Hardness (GPa, HK)[1] | 4.8 | 7.8 | 64% |
| Initial friction coefficient | 0.57 | 0.22 | 61% |
| Steady-state friction coefficient | 0.79 | 0.63 | 20% |
| Wear rate of TiAl ($mm^3$/N-m) | $2.17 \times 10^{-4}$ | non-measurable[2] | >1000X |
| Wear rate of steel counterface ($mm^3$/N-m) | $2.75 \times 10^{-6}$ | $1.68 \times 10^{-5}$ | — |
| Total wear rate ($mm^3$/N-m) | $2.20 \times 10^{-4}$ | $1.68 \times 10^{-5}$ | 92% |

[1]Microindentation Knoop's Hardness
[2]"non-measurable" indicates $<1 \times 10^{-7}$ FIG. 1 shows friction traces of OD-TiAl and untreated TiAl. As shown, the OD-TiAl (lower trace) possesses a lower friction coefficient in both running-in and steady-state stages as compared to the untreated TiAl (upper trace).

FIGS. 2A-2D show surface images of untreated TiAl (FIG. 2A) and its steel ball counterface (FIG. 2B), and surface images of OD-TiAl (FIG. 2C) and its steel ball counterface (FIG. 2D) after the tribological wear testing described above. As shown by these figures, the untreated TiAl surface has a significant wear scar with a correspondingly significant transfer of material onto the steel ball counterface; in contrast, the OD-TiAl surface possesses no wear scar, and on the contrary, a slight transfer of material onto it from the steel ball due to wearing of the steel ball on the OD-TiAl surface. The substantial absence of a transfer of material from the OD-TiAl surface to the steel ball (and hence, lack of scarring of the OD-TiAl surface) is also evident in the shiny appearance of the steel ball counterface used against the OD-TiAl surface, as compared to the significantly marred steel ball counterface used against the untreated TiAl surface.

Figure 3:
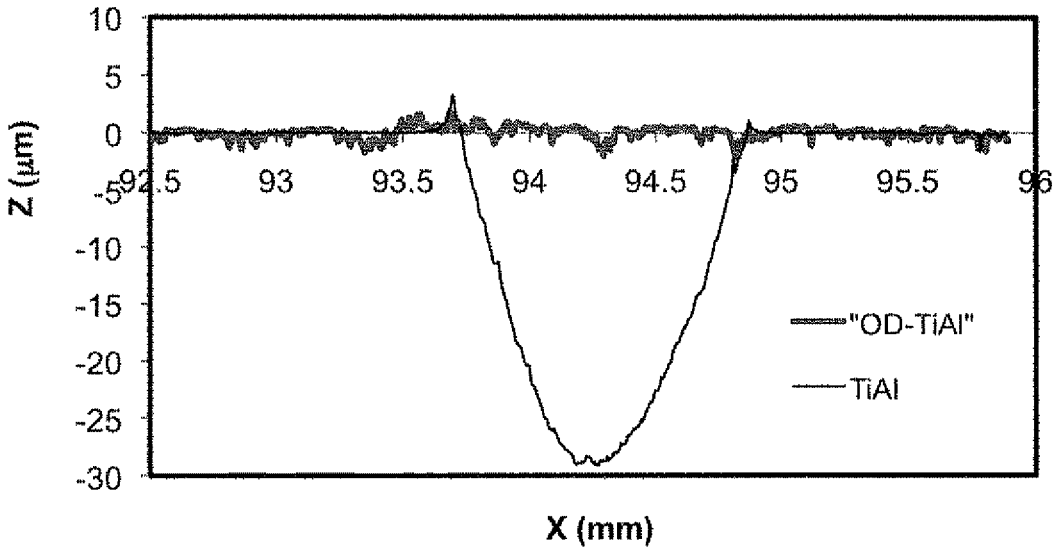
FIG. 3. Graph showing surface cross-section profiles for untreated TiAl and OD-TiAl surfaces after undergoing the 10,000 cycles of dry sliding against a AISI 52100 bearing steel ball.

FIG. 3 shows the surface cross-section profiles for both OD-TiAl and untreated TiAl after the tribological wear testing described above. As shown by FIG. 3, the untreated TiAl surface has a wear scar of about 30 μm deep (bottom trace), while the OD-TiAl shows no measurable material loss (top trace), and thus, no wear scar.

While there have been shown and described what are at present considered the preferred embodiments of the invention, those skilled in the art may make various changes and modifications which remain within the scope of the invention defined by the appended claims.

What is claimed is:

1. A method for producing a wear-resistant titanium aluminide intermetallic alloy, the method comprising heating a titanium aluminide intermetallic alloy in an oxygen-containing environment at a temperature of at least 950° C. for a processing time of at least about 1 hour to produce a top oxide layer and underlying oxygen -diffused layer, followed by removal of the entire top oxide layer such that the oxygen-diffused layer is exposed.

2. The method of claim 1, wherein said titanium aluminide intermetallic alloy is selected from the group consisting of $Ti_3Al$, TiAl, and $TiAl_3$.

3. The method of claim 1, wherein said temperature is at least 1000° C.

4. The method of claim 1, wherein said oxygen-diffused layer has a thickness of 1-300 microns.

5. The method of claim 1, wherein said oxygen-diffused layer has a thickness of 1-100 microns.

6. The method of claim 1, wherein said oxygen-diffused layer has a thickness of 1-50 microns.

7. The method of claim 1, wherein said top oxide layer is removed by abrasion.

8. The method of claim 1, further comprising shaping said wear-resistant titanium aluminide intermetallic alloy into a mechanical component.

9. The method of claim 1, wherein said titanium aluminide intermetallic alloy is in the shape of a mechanical component.

10. The method of claim 8 or 9, wherein said mechanical component is a bearing.

11. The method of claim 10, wherein said bearing is a slide bearing.

12. The method of claim 8 or 9, wherein said mechanical component is a component normally subjected to elevated temperatures and required to be heat resistant.

13. The method of claim 12, wherein said mechanical component is selected from the group consisting of a turbine fan, compressor blade, a part of a thermal protection system, an exhaust engine valve, piston, and a turbocharger.

14. The method of claim 1, wherein said wear-resistant titanium aluminide intermetallic alloy has a microindentation Knoop's hardness of at least 6.0 GPa.

15. The method of claim 1, wherein said wear-resistant titanium aluminide intermetallic alloy has a microindentation Knoop's hardness of at least 7.0 GPa.

16. The method of claim 1, wherein said wear-resistant titanium aluminide intermetallic alloy possesses a wear rate that is at least 10 times less, under substantially identical testing conditions, compared to the wear rate of a titanium aluminide intermetallic alloy of same composition but not possessing said exposed oxygen-diffused layer.

17. The method of claim 1, wherein said wear-resistant titanium aluminide intermetallic alloy possesses a steady-state friction coefficient that is at least 10% reduced, under substantially identical testing conditions, compared to the steady-state friction coefficient of a titanium aluminide intermetallic alloy of same composition but not possessing said exposed oxygen -diffused layer.

18. The method of claim 1, wherein said temperature is at least 1050° C.

19. The method of claim 1, wherein said temperature is about 1100° C.

20. The method of claim 1, wherein said temperature is up to about 1100° C.

* * * * *